United States Patent [19]

Tuomainen

[11] Patent Number: 4,686,418

[45] Date of Patent: Aug. 11, 1987

[54] PLATE-SHAPED DISPLAY STRUCTURE

[75] Inventor: Tapio Tuomainen, Virkkala, Finland

[73] Assignee: Oy Lohja AB, Virkkala, Finland

[21] Appl. No.: 739,200

[22] Filed: May 30, 1985

[30] Foreign Application Priority Data

Jun. 7, 1984 [FI] Finland ..... 842309

[51] Int. Cl.[4] ..... H05B 33/04

[52] U.S. Cl. ..... 313/512

[58] Field of Search ..... 313/493, 512; 220/2.1 R; 445/24, 25; 174/52 FP; 361/395, 398

[56] References Cited

U.S. PATENT DOCUMENTS 4,508,990 4/1985 Essinger ..... 313/512 X

*Primary Examiner*—Palmer C. DeMeo
*Assistant Examiner*—Sandra L. O'Shea
*Attorney, Agent, or Firm*—Fitzpatrick, Cella, Harper & Scinto

[57] ABSTRACT

The present publication describes a plate-shaped display structure, in particular an electroluminescent display structure. The structure comprises a frame, e.g. a rack-like frame, a printed-circuit plate fitted to and supported on the frame, wherein the printed-circuit plate is provided with first contact areas a display plate, preferably made of glass, which is fitted onto the printed-circuit plate at a distance from the latter and which is provided with second contact areas, a fastening structure for attaching the display plate and the printed-circuit plate to each other, and connecting conductors, which interconnect the first and the second contact areas. According to the invention, the fastening structure comprises a so-called two-sided resilient tape, provided intermediate the printed-circuit plate and the display plate to cause those two plates to adhere to each other, and the display plate and the frame are dimensioned in such a way that they do not reach contact with each other. By means of the invention, it is easy to provide a resilient attachment of a fragile EL glass to the frame structure, wherein the EL glass has a plane fastening face and, at the same time, to maintain precise alignment relative the printed-circuit plate, from which the control signals for the EL glass come.

4 Claims, 1 Drawing Figure

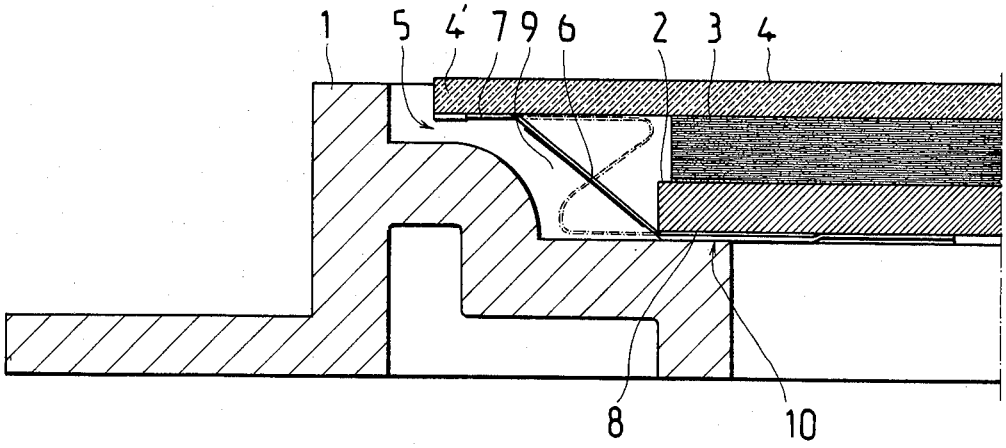
1
5
4'
7
9
6
2
3
4
8
10

PLATE-SHAPED DISPLAY STRUCTURE

The subject of the present invention is a plate-shaped electroluminescent display structure. As a rule, such a display structure comprises a rack-like frame, a printed-circuit plate attached to the frame, as well as a display plate, which is fitted onto the printed-circuit plate at a certain distance from the latter. The display plate is connected with the printed-circuit plate by means of a fastening structure. The contact areas corresponding to each other on the display plate and on the printed-circuit plate are interconnected by means of connection conductors.

In electroluminescent display technology (EL display technology) it is known in prior art to press the EL glass, functioning as the display plate, by its edges into a groove, wherein a resilient element placed in between consists of so-called zebra rubber. At the same time, this forms the contact between the EL glass and the printed-circuit plate. The necessary sound attenuation is, in this prior-art structure, provided by means of a separatedly cast mix.

Unless the EL glass is straight, it may be damaged on installation or on straining, because the zebra rubber requires a high compression force. The aligning of the EL glass and the printed-circuit plate relative to each other requires additional guides. Moreover, the separate sound attenuation mix involves an additional cost and requires an extra working step.

The object of the present invention is to eliminate the drawbacks occurring in the prior-art technique and to provide a plate-shaped display structure of an entirely new type.

The present invention is based on the fact that the fastening of the display plate to the frame takes place by means of the intermediate element of the printed-circuit plate. The display plate (comprising an EL glass laminate) does not contact the frame, but it is "suspended" on the printed-circuit plate by means of a two-sided tape.

By means of the invention, considerable advantages are obtained. Thus, the structure becomes flat, resistant to mechanical strains, and it attenuates sound. It is easy to manufacture, and it is reliable and inexpensive. Moreover, by means of the invention, it is easy to provide a resilient attachment to the frame structures for the fragile EL glass having a plane fastening face and, at the same time, to maintain precise alignment relative the printed-circuit plate, from which the control signals for the EL glass come.

The invention will be examined in the following in more detail with reference to the accompanying drawing. The drawing is a partial longitudinal sectional view of one embodiment of the display structure in accordance with the invention, whereby it is considered that the direction of viewing is from the top downwards.

The rack-shaped frame 1 is provided with an inside plane knee 10 so that the printed-circuit plate 2 can be attached to it as a plane. The attaching may be performed, e.g., by means of countersunk screws, for which screws holes in accordance with the ISO standard are made in the knee 10. At corresponding positions in the print-circuit plate 2, there are threaded rivet nuts.

It is important that there is a sufficiently large gap 5 available between the frame 1 and the glass plate 4 to allow for inward pressing of the glass plate 4. The magnitude of this gap depends, e.g., on the modulus of elasticity and the thickness of the two-sided tape 3 fitted between the glass plate 4 and the printed-circuit plate 2.

It has turned out that about 20 to 50 percent of the thickness of the tape 3 provides a sufficiently large gap. When, e.g., a 2 mm thick Kwikstik 2569 closed-cell UV-protected cellular PVC plastic is used as the tape 3, a sufficient gap is 0.5 to 1.0 mm, preferably about 0.8 mm.

The tape 3 is coated at both sides, e.g., with acrylic contact adhesive. The tape 3 is cut to the correct shape, the protective film is removed from one side of the tape, and the glass 4 and the tape 3 are aligned relative each other by means of a jig, and pressed together, whereby the tape 3 adheres to the glass 4 and protects its background during possible intermediate storage. The shear strength of the adhesive must be higher than the shear force caused by the glass in a situation of maximum strain. A safety factor of $n>200$ is readily attainable, whereby the structure endures even severe tests.

The printed-circuit plate 2 has a smooth back (requires one-sided setting of components), and the above-mentioned threaded rivet nuts are fixed in it. On the printed-circuit plate 2 and the glass 4, aligning markings have been made, by means of which they can be optically aligned relative to each other after they have been placed one above the other, upon removal of the protective film of the tape, with a spacing of about 1 to 2 mm from each other. When the alignment is correct, the glass 4 and the printed-circuit plate 2 are pressed into contact with each other. An appropriate compression force is about 5 $N/cm^2$, whereby the tape 3 is compressed by about 10 to 30%.

Afterward it is possible, by soldering by means of straight connection conductors 6, to join together the contact areas 7 and 8 placed at the edges of the glass plate 4 and the printed-circuit plate 2, respectively. The space 9 between the frame 1 and the projecting part 4' of the glass plate 4 is needed in order that the extra length of the conductors 6, provided as a reserve for resilience, can be accommodated without a risk of short circuit or, on the other hand, without a risk of breaking. Precise alignment and the retention of the same are necessary when the density of connections and the number of connections are high.

What is claimed is:

1. A plate-shaped display structure, in particular an electroluminescent display structure, which comprises a frame; a printed-circuit plate supported on the frame, which plate is provided with first contact areas; a display plate, preferably made of glass, which is fitted onto the printed-circuit plate, with a spacing being provided therebetween, and which is provided with second contact areas; a fastening structure for attaching the display plate and the printed-circuit plate to each other;

wherein said fastening structure comprises a so-called two-sided resilient tape provided intermediate the printed-circuit plate and the display plate to cause said plates to adhere to each other, and wherein the display plate and the frame are dimensioned in such a way that they do not make contact with each other.

2. A display structure as claimed in claim 1, wherein the tape has an acrylic contact adhesive on both sides thereof.

3. A display structure as claimed in claim 1, wherein between the frame and the inside face of the display plate there is a gap for the purpose of taking into account a deformation of the display plate.

4. A display structure as claimed in claim 3, wherein the magnitude of the gap is 0.5 to 1.0 mm., preferable about 0.8 mm.

* * * * *

UNITED STATES PATENT AND TRADEMARK OFFICE

CERTIFICATE OF CORRECTION

PATENT NO. : 4,686,418

DATED : August 11, 1987

INVENTOR(S) : TAPIO TUOMAINEN

It is certified that error appears in the above-identified patent and that said Letters Patent is hereby corrected as shown below:

AT [57] IN THE ABSTRACT

Line 6, "areas a" should read --areas, a--.

COLUMN 1

Line 21, "separatedly" should read --separately--.
Line 59, "screws" should read --screw--.
Line 61, "print-circuit" should read --printed-circuit--.

COLUMN 2

Line 66, "preferable" should read --preferably--.

Signed and Sealed this

Fifth Day of January, 1988

*Attest:*

DONALD J. QUIGG

*Attesting Officer*

*Commissioner of Patents and Trademarks*